US005792418A

United States Patent [19]

Krengel et al.

[11] Patent Number: 5,792,418

[45] Date of Patent: Aug. 11, 1998

[54] PROCESS AND DEVICE FOR PREVENTING NONPARALLELISM IN BEAM SECTIONS

[75] Inventors: Roland Krengel, Kerken; Hans-Peter Griess, Duisburg, both of Germany

[73] Assignee: Mannesmann Aktiengesellschaft, Düsseldorf, Germany

[21] Appl. No.: 547,704

[22] Filed: Oct. 19, 1995

[30] Foreign Application Priority Data

Oct. 19, 1994 [DE] Germany ..... 44 38 822.5

[51] Int. Cl.[6] ..... C21D 9/56

[52] U.S. Cl. ..... 266/117

[58] Field of Search ..... 266/88, 117, 259, 266/46, 44; 148/575

[56] References Cited

U.S. PATENT DOCUMENTS

| | | | |
|---|---|---|---|
| 2,378,044 | 6/1945 | Sorenson et al. | 266/117 |
| 3,151,197 | 9/1964 | Schultz | 266/117 |
| 3,738,629 | 6/1973 | Coleman | 266/117 |
| 4,149,703 | 4/1979 | Safford | 266/117 |
| 4,318,534 | 3/1982 | Thome et al. | 266/259 |
| 4,371,149 | 2/1983 | Takeuchi et al. | 266/117 |
| 4,611,789 | 9/1986 | Ackert et al. | 266/117 |
| 5,284,327 | 2/1994 | Arthur et al. | 266/259 |

*Primary Examiner*—Ronald L. Biegel

*Attorney, Agent, or Firm*—Cohen, Pontani, Lieberman, Pavane

[57] ABSTRACT

A process and device for preventing nonparallelism from occurring when rolling beams on universal beam rolling trains by partial application of coolant to the beams. The coolant is applied to the underside of the web during the rolling process in order to create an approximately symmetrical temperature profile in the web.

12 Claims, 2 Drawing Sheets

PROCESS AND DEVICE FOR PREVENTING NONPARALLELISM IN BEAM SECTIONS

BACKGROUND OF THE INVENTION

1. Field of the Invention

The invention relates to a process, and a device for carrying out the process, for preventing nonparallelism in beam sections which occurs during the rolling of beams on universal beam rolling mills by partial application of coolant to the beams.

2. Description of the Prior Art

A twisting or distortion of parallel flanges, referred to as nonparallelism in the DIN standard and as wide-top in English usage, is often observed at the delivery side of the finishing stand in universal beam rolling mill trains. The distortion of the beam sections during cooling is characterized by a widening of the top flange and a contraction of the bottom flange and poses a general problem. The nonparallelism of the flanges can be eliminated to a certain degree in downstream straightening machines insofar as it is possible to introduce the beams into these machines.

It is known to arrange cooling devices preferably downstream of the beam rolling trains and to use them to influence the structure after the rolling process. In other known cooling units the flanges are partially cooled during the rolling process to influence the transition region between the web and the flange with respect to the structural characteristics of the finished product. This is taught in DE-OS 1452106.

DE-A1-4009707 discloses a process for thermal straightening of rolled special sections which is employed only after the beam exits from the finishing stand. Spray-off devices upstream of the beam rolling mill trains which serve to eliminate the adhering scale are also known. The cooling effect which is brought about as a result these processes and devices is undesirable.

It has been found that the problem of nonparallelism in rolled beams discussed above is caused during the hot rolling of these beams in the universal roll stand or universal roll stands by coolant water continually running into the upper chamber of the horizontally rolled section which results in a one-sided cooling of the upper side of the web in this chamber. Since the lower chamber of the section barely comes into contact with the cooling water, the beam can be distorted to such an extent that it is difficult to eliminate this distortion with a straightening machine arranged downstream.

SUMMARY OF THE INVENTION

Based on the problems and disadvantages described above, the object of the present invention is to provide a process and a device for preventing nonparallelism and distortion of the beam during rolling in universal roll stands.

Pursuant to this object, and others which will become apparent hereafter, one aspect of the present invention resides in applying the coolant to the underside of the web so as to adjust an approximately symmetrical temperature profile in the web during the rolling process.

Thus the proposed process differs from known processes in that it is initiated during the rolling process and serves to partially cool the underside of the web. In this way, the asymmetrical temperature profile brought about in the web by the uncontrolled penetration of cooling water into the upper beam chamber is eliminated. That is, it has been found that a uniform temperature profile cannot be achieved by a one-time cooling after the finishing pass, but rather must be effected already in the upstream rolling passes during rolling. As a result of the steps of the present invention, the flanges can be maintained parallel during the subsequent cooling process since the rolling stock has an approximately uniform web temperature when exiting the finishing stand and possesses a small temperature gradient along the thickness of the web.

According to another embodiment of the invention, the cooling intensity is regulated by regulating the supply of coolant and/or the density of coolant application as a function of the temperature measured at the upper and lower sides of the web and the temperature difference calculated from this measurement. For this purpose, the surface temperatures on the upper side and underside of the web are detected by a measuring device and fed to a computer system which continuously determines the temperature distribution in the rolling stock and determines therefrom the time at which the coolant is turned on and the respective required density of water to be applied in each rolling pass.

A device for carrying out the inventive process includes coolant nozzles arranged in or in the immediate vicinity of at least one universal roll stand in the region of the underside of the web of the beam and are directed to the latter. As a result of this arrangement of the nozzles, the cooling of the underside of the web can already take place during the rolling process in one or more passes so as to avoid an intense cooling at the outlet of the finishing stand, which intense cooling can lead to cracks and distortion. The continuous cooling via the coolant nozzles enables a purposeful control of the homogenization of the temperature profile which cannot be achieved by means of cooling after the rolling process and due to the large temperature gradients within the web which are brought about in connection with this cooling.

The coolant nozzles are preferably arranged in the region of the reversing roll stands. When rolling beams in continuous universal beam rolling mill trains, the coolant nozzles are advantageously arranged at a plurality of locations within the rolling mill train.

In another embodiment of the invention the coolant nozzles are arranged on successive spray bars so that the coolant nozzles are offset laterally one after the other and are inclined relative to the rolling direction. In this way, the largest possible surface-area coverage is achieved for the coolant so as to enable a particularly intensive cooling action.

According to another embodiment of the invention, the individual coolant nozzles can be switched on and off separately so that the width of the cooling area and the application density of the coolant can be regulated.

Still a further embodiment of the invention utilizes coolant nozzles with round or oval spray patterns. While in yet another embodiment, coolant nozzles with fan-jet nozzles which can be aligned to the beam section with rotatable adjustment are used.

The emphasis in the process and the device for carrying out this process, according to the invention, is not placed on influencing the structure with the corresponding metallurgical properties, but rather lies in maintaining in a purposeful manner an approximately symmetrical temperature profile in the web with the resulting parallelism of the flanges. This is achieved in a simple manner by means of the steps of the invention so as to improve product quality on the one hand and minimize reworking and expenditure on straightening machines on the other hand.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
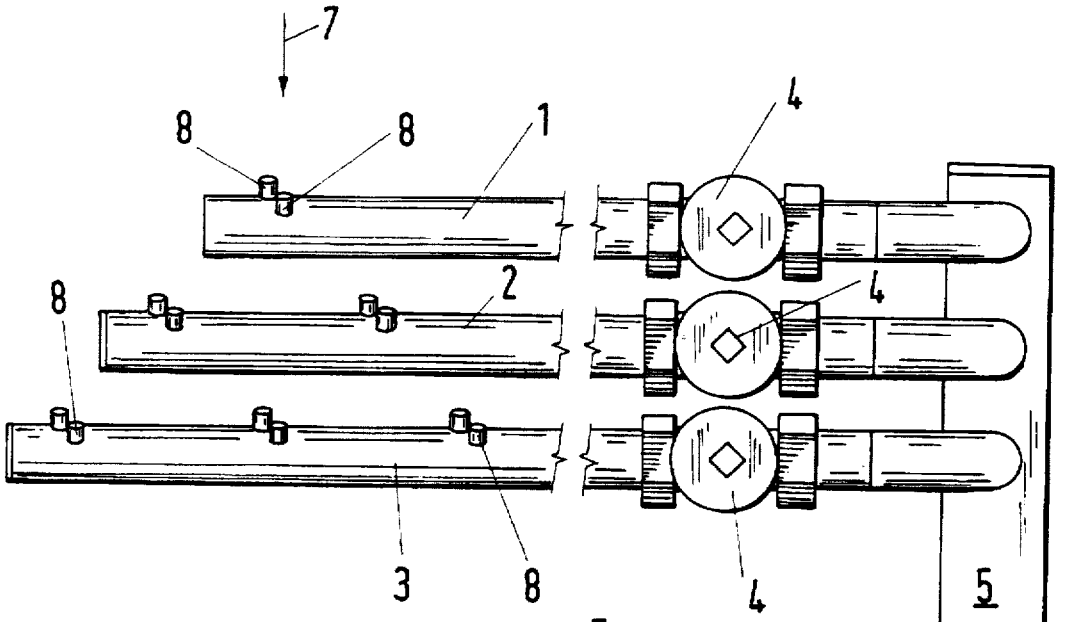
FIG. 1 shows the arrangement of the coolant nozzles on spray bars pursuant to the present invention.

As can be seen in FIG. 1, three spray bars 1, 2, 3 communicate via gate valves 4 with a water pipe 5 which is likewise provided with a gate valve 6. Spray nozzles 8 are arranged in pairs on the spray bars 1, 2, 3 so as to be offset laterally with respect to one another and inclined relative to the rolling direction 7 of the beam. The nozzles 8 are also arranged in different lateral positions with respect to the rolling direction 7. Different coolant nozzles 8 can be triggered by separately switching the individual spray bars 1 or 2 or 3 on and off by means of the gate valves 4. The width and application density of the coolant can be controlled in this way.

Figure 2:
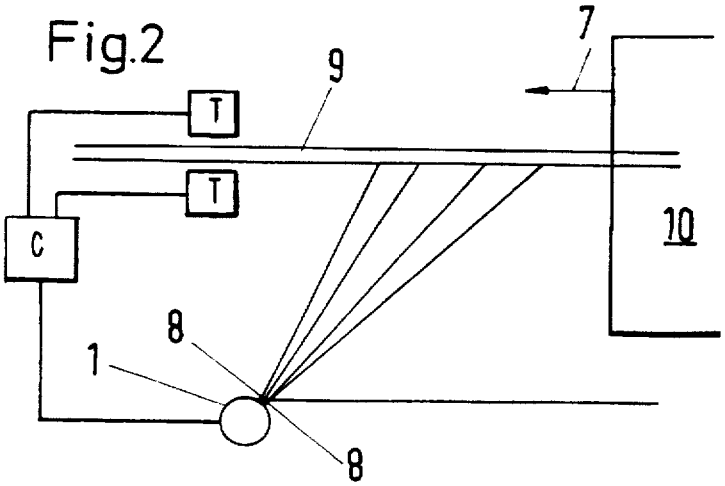
FIG. 2 shows a schematic side view of the position of a spray bar.

In FIG. 2, one of the coolant bars 1 is shown schematically under the roller table planes 9 upstream of a universal roll stand 10. It can be seen from FIG. 2 that the coolant nozzles 8 are inclined toward the rolling direction 7 and the coolant stream is accordingly applied to the underside of the web so as to be directed opposite to the rolling direction.

Figure 3B:
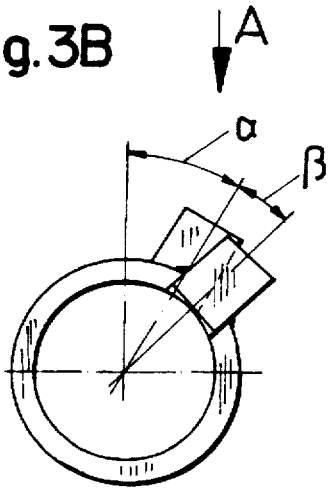
FIG. 3B is a side view of FIG. 3A.
Figure 3A:
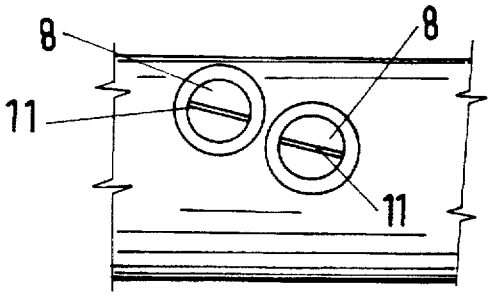
FIG. 3A shows the arrangement of two coolant nozzles on the spray bar.

FIGS. 3A and 3B show the arrangement of two coolant nozzles 8 on the spray bar 1 which is constructed as a pipe. The nozzle slots 11 are rotatable, (shown in FIG. 3A) so that the width and overlapping of the individual coolant jets can be adapted to the chamber width of the beam. It can be seen in FIG. 3B that the coolant nozzles are arranged on the spray bar (water feed-line pipe) 1 so as to be offset relative to one another and so as to direct the coolant (i.e., water) onto the beam at different angles $\alpha$ and $\beta$. In this way, the greatest possible coolant application surface is adjusted at the beam and an intensive cooling effect is accordingly achieved.

Figure 6:
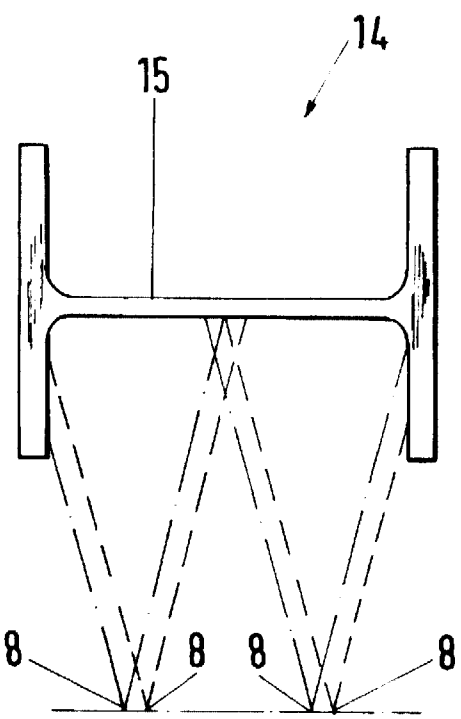
FIGS. 4 to 6 show the spraying of the underside of the beam web of beams of various widths.
Figure 5:
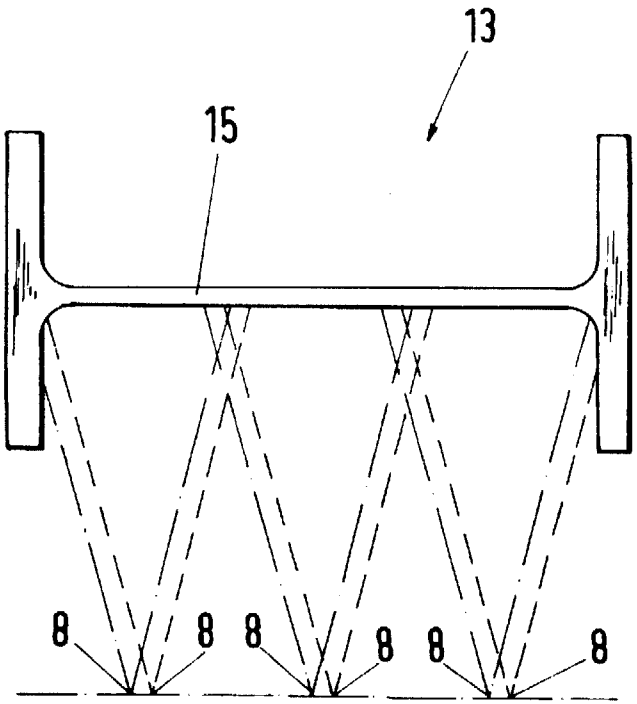
Figure 4:
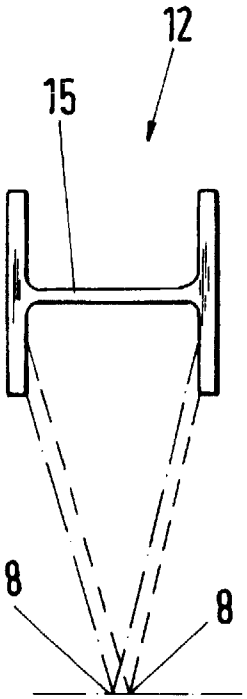

Beams 12, 13 and 14 of various widths are shown in FIGS. 4 to 6. As will be seen from FIG. 4, two coolant nozzles 8 are arranged adjacent to one another so as to be offset laterally as shown on the spray bar 1 in FIG. 1, and play on the entire width of the web 15. In the case of an extremely wide beam 13 such as that shown schematically in FIG. 5, three coolant nozzle pairs with coolant nozzles 8 are used. This corresponds to the arrangement of the spray bar 3 in FIG. 1. A beam of medium width 14 is shown in FIG. 6 and is sprayed by two coolant nozzle pairs, which corresponds to spray bar 2 in FIG. 1. Fan-jet nozzles that have rotatable adjustment are used in this embodiment. These fan-jet nozzles enable advantageous adjustment to the width of the respective web 15. Of course, it is also possible to use a plurality of spray bars at the same time, i.e., more coolant nozzles than are necessary for the width of the web, e.g., in order to increase the cooling intensity. It is also possible to use nozzles that provide round or oval spray patterns.

The invention is not limited by the embodiments described above which are presented as examples only but can be modified in various ways within the scope of protection defined by the appended patent claims.

I claim:

1. A process for preventing nonparallelism of a beam section occurring when a beam, which has a web, is rolled on a universal rolling train and a partial application of coolant to the beam takes place, the process comprising the step of applying the coolant to an underside of the beam during rolling in order to adjust an approximately symmetrical temperature profile in the beam web.

2. A device for preventing nonparallelism of a beam section that occurs when a beam, which has a web, is rolled in a universal beam rolling train having at least one universal roll stand, and is partially cooled by a coolant, the device comprising a plurality of coolant nozzles arrangeable at the at least one universal roll stand in a region of an underside of the web of the beam, said nozzles being directed toward the underside of the beam so as to cool the underside of the beam during rolling.

3. A device according to claim 2, wherein the coolant nozzles are arranged in the region of reversing universal roll stands of the rolling train.

4. A device according to claim 2, wherein the coolant nozzles are arranged at a plurality of locations within the universal rolling train.

5. A device according to claim 2, and further comprising successively arranged coolant spray bars, the coolant nozzles being arranged on the successive spray bars so as to be offset laterally one after another and inclined relative to a rolling direction of the beam.

6. A device according to claim 2, and further comprising means for separately switching each of the coolant nozzles on and off.

7. A device according to claim 5, and further comprising means for separately switching each of the coolant nozzles on and off.

8. A device according to claim 7, wherein the switching means includes gate valves arranged in each of the successive spray bars.

9. A device according to claim 2, wherein the coolant nozzles are configured to have a round spray pattern.

10. A device according to claim 2, wherein the coolant nozzles are configured to have an oval spray pattern.

11. A device according to claim 2, wherein the coolant nozzles are fan-jet nozzles with rotatable adjustment.

12. A device according to claim 5, wherein the spray bars extend beneath the beam perpendicular to the rolling direction, each of the spray bars having a different length and a different number of the coolant nozzles being arranged along each of the spray bars.

* * * * *